US007422515B1

(12) United States Patent
Chang

(10) Patent No.: US 7,422,515 B1
(45) Date of Patent: Sep. 9, 2008

(54) WIDE BELT SANDER

(76) Inventor: Wen-Chi Chang, No. 1111, Chungshan Rd., Shen-Kang Hsiang, Taichung Hsien (TW)

( * ) Notice: Subject to any disclaimer, the term of this patent is extended or adjusted under 35 U.S.C. 154(b) by 41 days.

(21) Appl. No.: 11/710,645

(22) Filed: Feb. 23, 2007

(51) Int. Cl.
*B24B 21/00* (2006.01)

(52) U.S. Cl. ..... 451/297; 451/300

(58) Field of Classification Search ..... 451/296, 451/297, 299, 300, 489
See application file for complete search history.

(56) References Cited

U.S. PATENT DOCUMENTS 3,504,458 A * 4/1970 Rutt ..... 451/1
3,900,973 A * 8/1975 van der Linden ..... 451/297
4,369,601 A * 1/1983 Gerber ..... 451/297
4,651,474 A * 3/1987 David ..... 451/300
5,184,424 A * 2/1993 Miller ..... 451/297
6,089,958 A * 7/2000 Costa et al. ..... 451/59
6,342,000 B1 * 1/2002 Yan ..... 451/304

* cited by examiner

*Primary Examiner*—Eileen P. Morgan
(74) *Attorney, Agent, or Firm*—Charles E. Baxley

(57) ABSTRACT

A wide belt sander has a base, a driving axle, a driving device, a driven axle bracket, a driven axle, a belt and an automatic adjustment device. The driving axle is rotatably mounted on the base and has a central axis. The driving device is mounted on the base and is connected to the driving axle. The driven axle bracket is rotatably mounted on the base along a longitudinal axis perpendicular to the central axis of the driving axle. The driven axle is rotatably mounted on the driven axle bracket along a rotating axis parallel with the central axis of the driving axle. The belt is endlessly mounted around the driving and driven axles. The automatic adjustment device is mounted between the base and the driven axle bracket to drive the driven axle bracket to swing relative to the base in a simple harmonic motion.

12 Claims, 7 Drawing Sheets

WIDE BELT SANDER

BACKGROUND OF THE INVENTION

1. Field of the Invention

The present invention relates to a sander, and more particularly to a wide belt sander that is durable in use and convenient in replacing belt.

2. Description of Related Art

To polish surfaces of an article, a sander is always used and substantially comprises a base, two axles, a driving device and a belt. The axles are rotatably mounted on the base and are arranged in parallel. The driving device is mounted on the base and drives the axles to rotate. The belt is endlessly mounted around the axles and is driven to move endlessly when the driving device is switched on. With abutting surfaces of an article against the running belt, the surfaces of the article are polished.

However, travel of the running belt of the conventional sander easily has deviation to cause the movement of the belt unstable, such that the force applied to the running belt and the polished article is uneven and the belt is easily worn off.

In addition, the distance between the axles of the conventional sander is fixed and unchangeable, to replace a worn belt with a new one is difficult and troublesome.

To overcome the shortcomings, the present invention tends to provide a wide belt sander to mitigate or obviate the aforementioned problems.

SUMMARY OF THE INVENTION

The main objective of the invention is to provide a wide belt sander that is durable in use and convenient in replacing belt. The wide belt sander has a base, a driving axle, a driving device, a driven axle bracket, a driven axle, a belt and an automatic adjustment device. The driving axle is rotatably mounted on the base and has a central axis. The driving device is mounted on the base and is connected to the driving axle. The driven axle bracket is rotatably mounted on the base along a longitudinal axis perpendicular to the central axis of the driving axle. The driven axle is rotatably mounted on the driven axle bracket along a rotating axis parallel with the central axis of the driving axle. The belt is endlessly mounted around the driving and driven axles. The automatic adjustment device is mounted between the base and the driven axle bracket to drive the driven axle bracket to swing relative to the base along the longitudinal axis in a simple harmonic motion.

Other objects, advantages and novel features of the invention will become more apparent from the following detailed description when taken in conjunction with the accompanying drawings.

DETAILED DESCRIPTION OF PREFERRED EMBODIMENT

Figure 1:
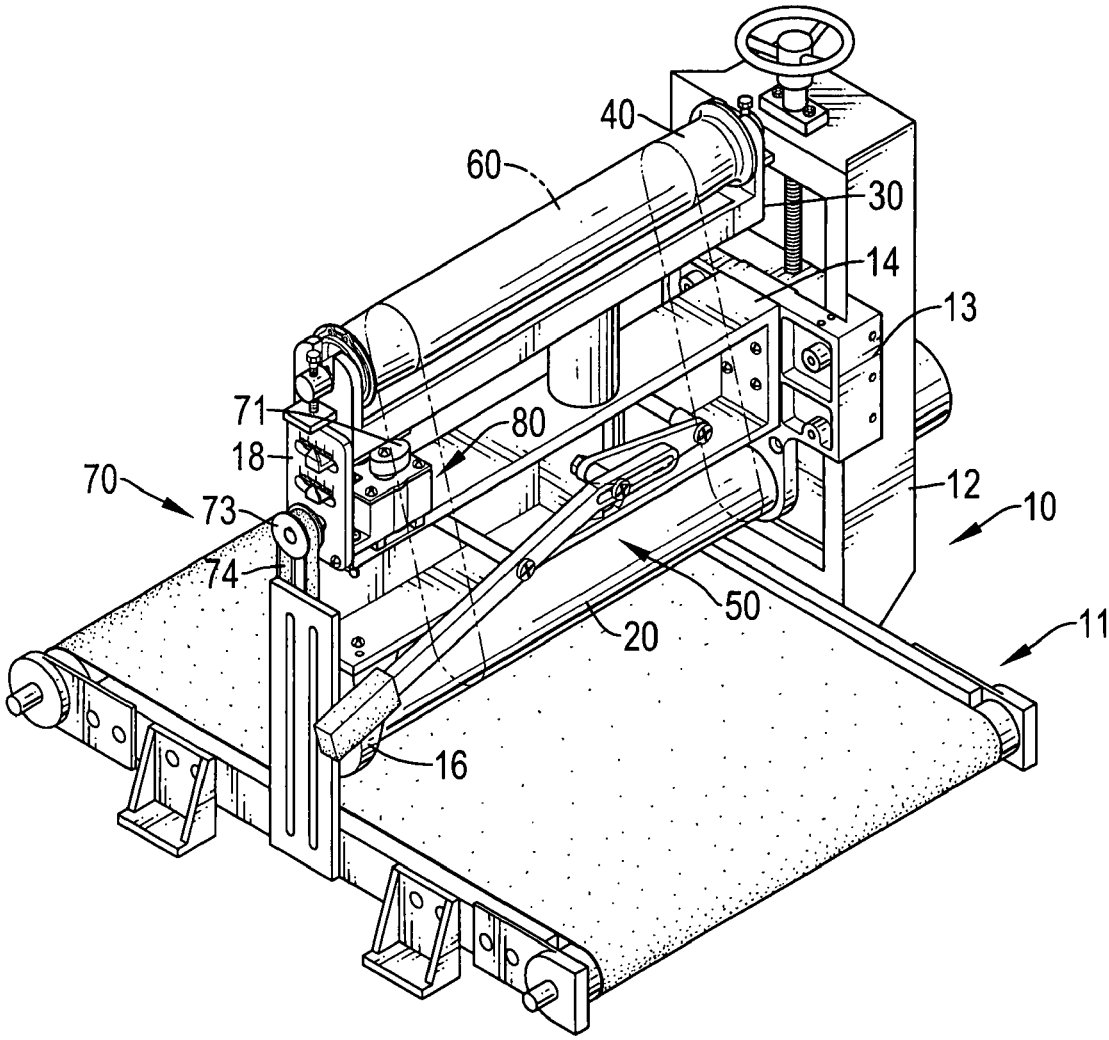
FIG. 1 is a perspective view of a wide belt sander in accordance with the present invention.
Figure 2:
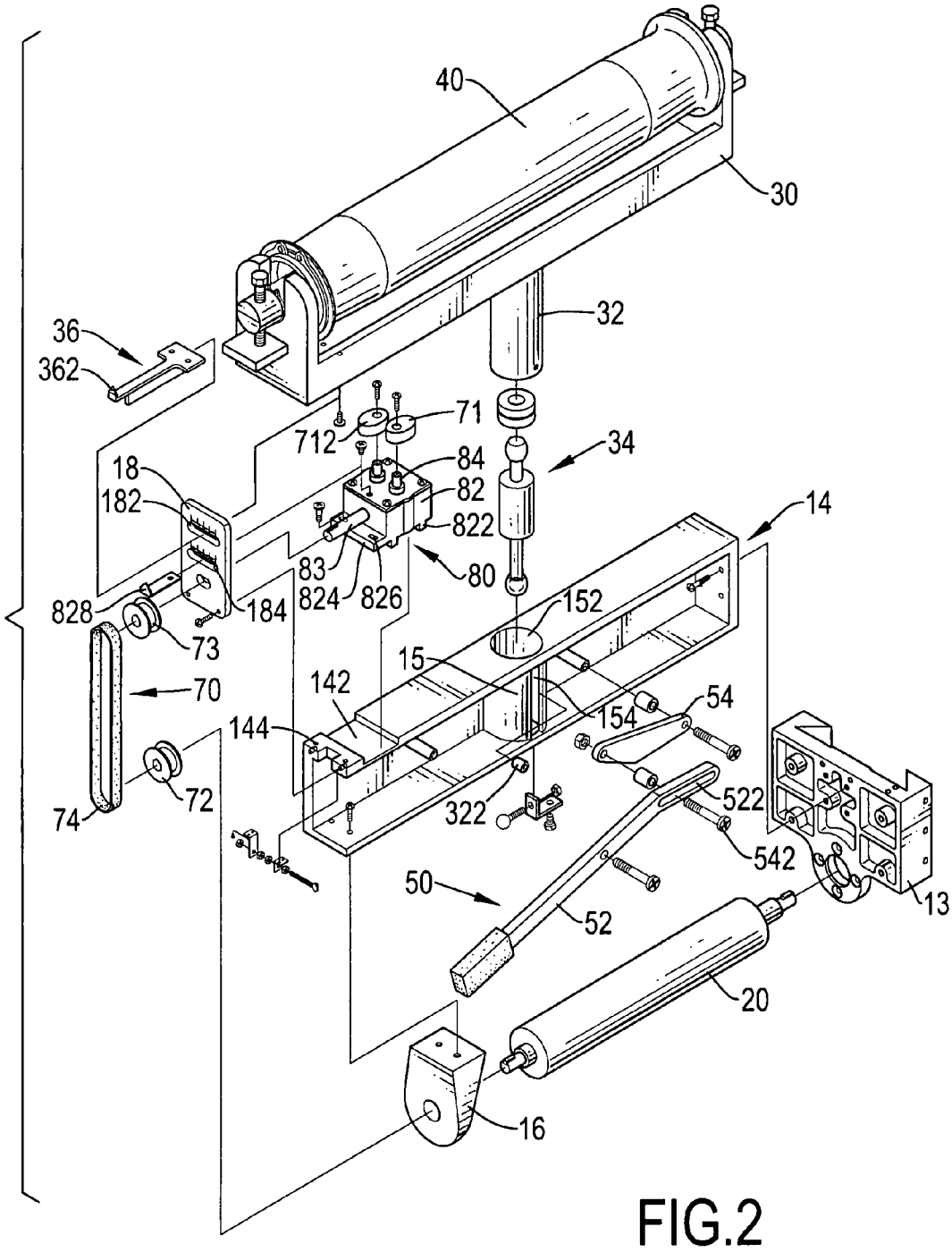
FIG. 2 is an exploded perspective view of the wide belt sander in FIG. 1.

With reference to FIGS. 1 and 2, a wide belt sander in accordance with the present invention comprises a base (10), a driving axle (20), a driving device, a driven axle bracket (30), a driven axle (40), a belt (60) and an automatic adjustment device (70). The base (10) comprises a bottom frame (11), a column (12), a slider (13), a holding bracket (14) and an axle frame (16). A second belt may be endlessly mounted on the bottom frame (11) in a horizontal direction to provide a further polishing effect. The column (12) is upwardly mounted on the bottom frame (11), and the slider (13) is slidably mounted on the column (12). The holding bracket (14) is securely mounted on the slider (13) and has a top, a channel (142), two threaded holes (144), a central sleeve (15) and an indicating board (18). The channel (142) is defined in the top of the holding bracket (14). The threaded holes (144) are defined in the top of the holding bracket (14) near the channel (142). The central sleeve (15) is mounted on the holding bracket (14) and has a central hole (152).

Figure 3:
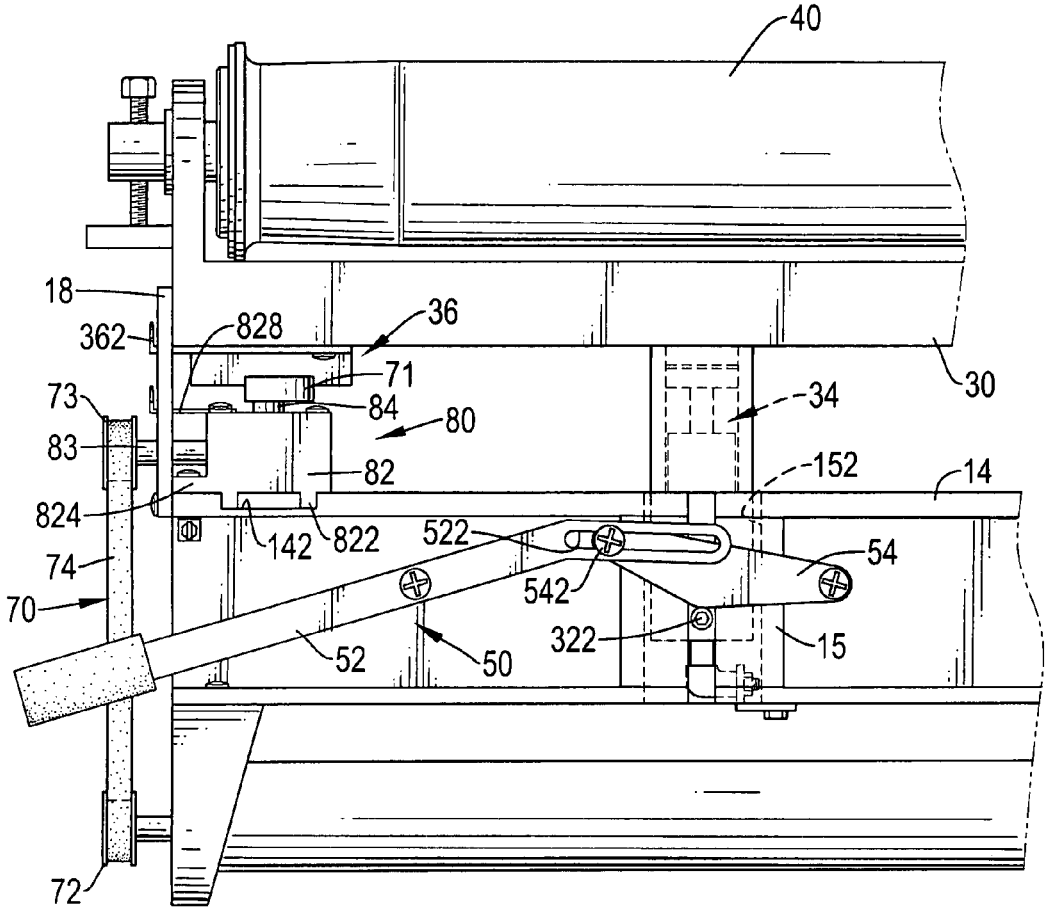
FIG. 3 is an enlarged front view of the wide belt sander in FIG. 1.
Figure 9:
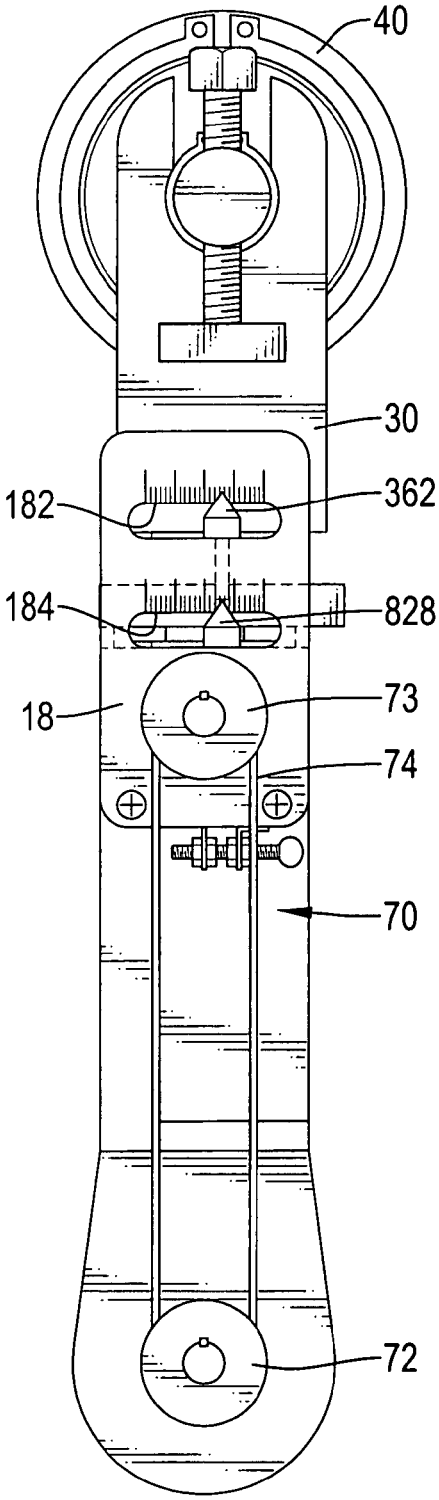
FIG. 9 is a side view of the automatic adjustment device of the wide belt sander in FIG. 1.

With further reference to FIGS. 3 and 9, the indicating board (18) is securely attached to the holding bracket (14) and has an upper indication channel (182) and a lower indication channel (184). The upper indication channel (182) is laterally defined through the indicating board (18), and the lower indication channel (184) is laterally defined through the indicating board (18) and is parallel with the upper indication channel (182).

The axle frame (16) is securely attached to the holding bracket (14) at one end opposite to the slider (13).

The driving axle (20) is rotatably mounted between the slider (13) and the axle frame (16) below the holding bracket (14) and has a central axis. The channel (142) in the top of the holding bracket (14) is defined along a direction perpendicular to the central axis of the driving axle (20).

The driving device is mounted on the base (10), preferably on the slider (13), is connected to and drives the driving axle (20) and may include a motor.

The driven axle bracket (30) is rotatably mounted on the base (10) along a longitudinal axis perpendicular to the central axis of the driving axle (20). The driven axle bracket (30) has a central shaft (32) formed on and extending downward from the driven axle bracket (30) and rotatably extending into the central hole (152) in the central sleeve (15).

In addition, a pneumatic cylinder (34) is mounted between the holding bracket (14) and the driven axle bracket (30). The pneumatic cylinder (34) has a first end connected to the driven axle bracket (30) with a thrust bearing and a second end connected to the holding bracket (14) with a universal jointer.

The driven axle (40) is rotatably mounted on the driven axle bracket (30) along a rotating axis parallel with the central axis of the driving axle (20).

The belt (60) is endlessly mounted around the driving and driven axles (20,40).

Furthermore, an axle adjusting device (50) is mounted between the base (10) and the driven axle bracket (30) to change a distance between the driving and driven axles (20, 40). The axle adjusting device (50) comprises a handlebar (52), a pushing plate (54) and a pushed rod (322). The handlebar (52) is pivotally attached to the holding bracket (14) and has a guiding channel (522) defined through the handlebar (52) at one end of the handlebar (52). The pushing plate (54) is pivotally mounted on the holding bracket (14) and is pivotally and slidably connected to the guiding channel (522) in the handlebar (52) with a sliding pivot (542). The pushed rod (322) is mounted on and radially extends from the central shaft (32) and abuts with the pushing plate (54). In addition, a guiding slot (154) is longitudinally formed in the central sleeve (15) on the holding bracket (14), and the pushed rod (322) extends into the guiding slot (154) in the central sleeve (15). With the guiding slot (154), the central shaft (32) with the pushed rod (322) can move along the guiding slot (154) smoothly.

With reference to FIG. 3, when a user pulls the handlebar (52) upward, the pushing plate (54) will be pivoted relative to the holding bracket with the pivot (542) sliding along the guiding channel (522) and pushes against the pushed rod (322) on the central shaft (32). Consequently, the central shaft (32) will move downward along the guiding slot (154), and the driven axle bracket (30) moves downward to reduce the distance between the driving and driven axles (20,40). Accordingly, to detach and replace the belt (60) between the axles (20,40) are convenient and easy with the reduction of the distance between the axles (20,40). After the belt (60) be replaced and the handlebar (52) being released, the driven axle bracket (30) with the driven axle (40) will be pushed to an expanding position with the force provided by the pressed pneumatic cylinder (34). Addition, the pneumatic cylinder (34) can also provide a supporting and damping effect to the driven axle bracket (30).

With reference to FIGS. 1 to 3 and 6, the automatic adjustment device (70) is mounted between the base (10) and the driven axle bracket (30) to drive the driven axle bracket (30) to swing relative to the base (10) along the longitudinal axis in a simple harmonic motion.

The automatic adjustment device (70) comprises two cams (71,712), a pushed element (36) and a driving assembly. The cams (71,712) are rotatably mounted on the base (10) at an interval and correspond to the driven axle bracket (30).

The pushed element (36) is securely attached to the driven axle bracket (30) and is mounted between and alternatively pushed by the cams (71,712) to swing the driven axle bracket (30) relative to the base (10). In a preferred embodiment, the cams (71,712) are arranged symmetrically to the pushed element (36) and alternatively push the pushed element (36) at a 180° interval. The pushed element (36) may further have an upper pointer (362) formed on one end of the pushed element (36) and extending into the upper indication channel (182) in the indicating board (18). With the arrangement of the upper pointer (362) and the upper indication channel (182), the position of the driven axle bracket (30) is identified.

The driving assembly is mounted on the base (10) to drive the cams (71,712) to rotate and comprises a driving pulley (72), a driven pulley (73), a transmission device (80) and a driving belt (74). The driving pulley (72) is coaxially connected to and rotates with the driving axle (20). The driven pulley (73) is connected to the cams (71,712) with the transmission device (80). The transmission device (80) comprises a gear box (82), a driving shaft (83), two driven shafts (84) and a gear device. The gear box (82) is adjustably attached on the holding bracket (14) of the base (10). The gear box (82) has a bottom and two ribs (822) formed on the bottom and slidably held in the channel (142) in the holding bracket (14). A wing (824) is mounted on and laterally extends from the bottom of the gear box (82) and has two elongated holes (826) defined through the wing (824) and aligning respectively with the threaded holes (144) in the holding bracket (14). With two fasteners extending through the elongated holes (826) in the wing (824) and screwed into the corresponding threaded holes (144) in the holding bracket (14), the gear box (82) is securely mounted on the holding bracket (14). With releasing the fasteners, the gear box (82) can be moved along the channel (142) in the holding bracket (14) to adjust the position of the gear box (82) relative to the holding bracket (14). Additionally, the gear box (82) further comprises a lower pointer (828) securely mounted on the gear box (82) and extending into the lower indication channel (184) in the indicating board (18). With the arrangement of the lower pointer (828) and the lower indication channel (184), the position of the gear box (82) is identified.

The driving shaft (83) is rotatably mounted on and extends into the gear box (82), and the driven pulley (72) is mounted on the driving shaft (83). The driven shafts (84) are rotatably mounted on and extend out from the gear box (82) ad are arranged in parallel, and the cams (71,712) are attached respectively on the driven shafts (84). Accordingly, with the movement of the gear box (80), the position of the cams (71,712) relative to the pushed element (36) is also adjusted.

Figure 4:
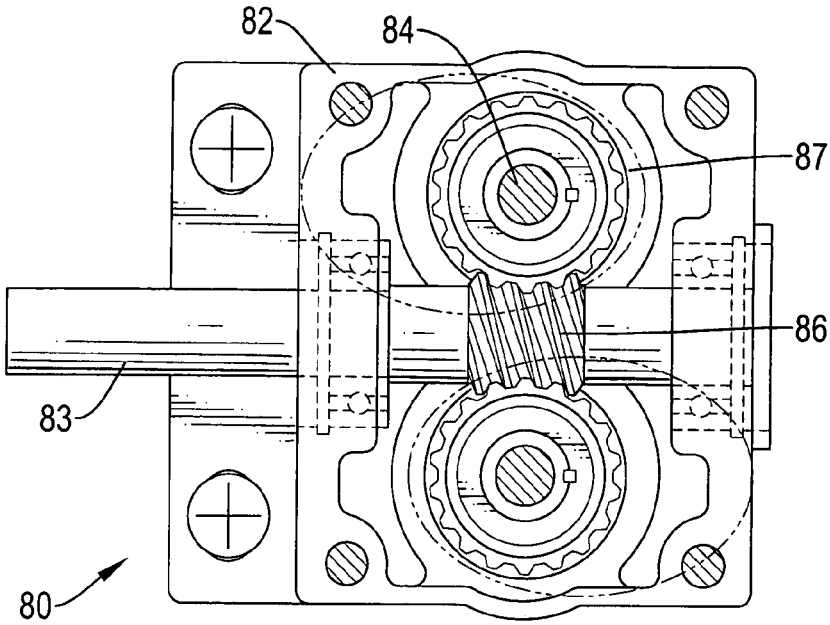
FIG. 4 is a top view in partial section of the transmission device of the automatic adjustment device of the wide belt sander in FIG. 1.
Figure 5:
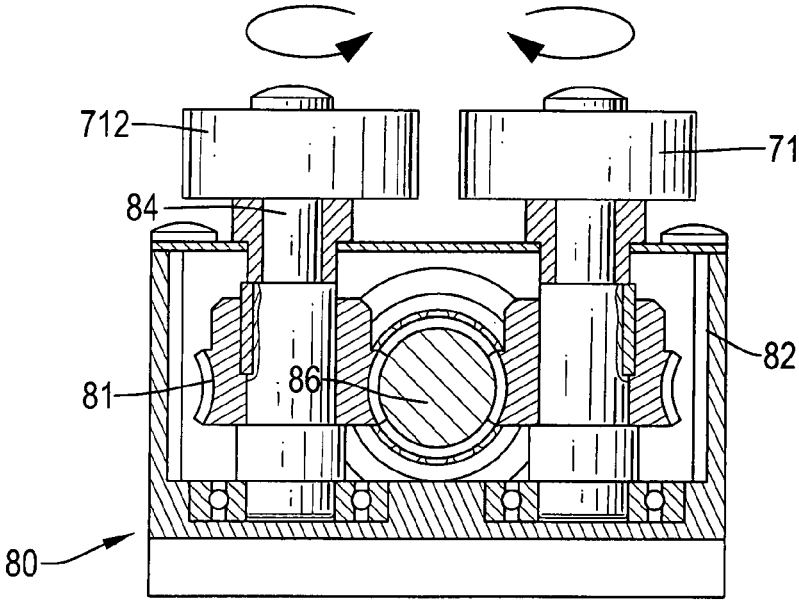
FIG. 5 is an operational top view in partial section of the transmission device in FIG. 4.

The gear device is mounted in the gear box (82) and is connected between the driving shaft (83) and the driven shafts (84) to drive the driven shafts (84) to rotate in reverse directions. With further reference to FIGS. 4 and 5, the gear device of the transmission device (80) comprises a worm rod (86) and two worm gears (87). The worm rod (86) is coaxially mounted on the driving shaft (83). The worm gears (87) are securely and respectively mounted on the driven shafts (84) and engage with the worm rod (86).

The driving belt (74) is mounted around the driving pulley (72) and the driven pulley (73).

Figure 10:
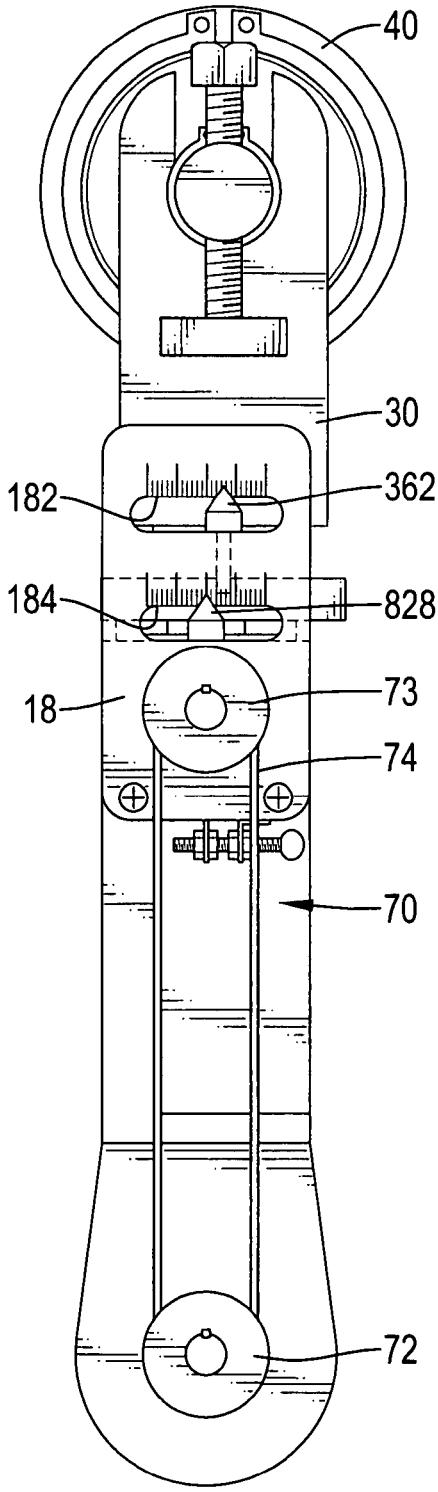
FIG. 10 is an operational side view of the automatic adjustment device in FIG. 9.

Before the wide belt sander is in used, the positions of the driven axle bracket (30) and the cams (71,712) of the automatic adjustment device (70) must be zeroized. With reference to FIGS. 9 and 10, to zeroize the position of the driven axle bracket (30), the driving belt (74) is detached from the driving and driving pulleys (72,73) and the driving device is switched on. With the rotation of the driving axle (20) driven by the driving device, the driven axle (40) will be rotated with the transmission of the belt (60). Because the driven axle bracket (30) is rotatably mounted on the holding bracket (14) with the central shaft (32), the angular position of the driven axle bracket (30) is adjusted relative to the holding bracket (14) to make the belt (60) running in a desired travel track.

Then, the fasteners on the gear box (82) are released, and the position of the gear box (82) is adjusted along the channel (142) in the holding bracket (14) to make the distances between the pushed element (36) and the cams (71,712) being equal. Accordingly, the driven axle bracket (30) and the cams (71,712) are zeroized.

Figure 6:
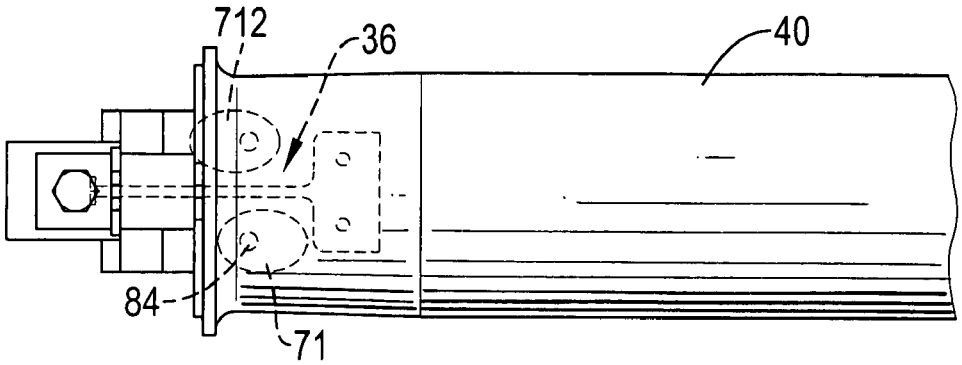
FIG. 6 is an enlarged top view of the automatic adjustment device of the wide belt sander in FIG. 1.
Figure 7:
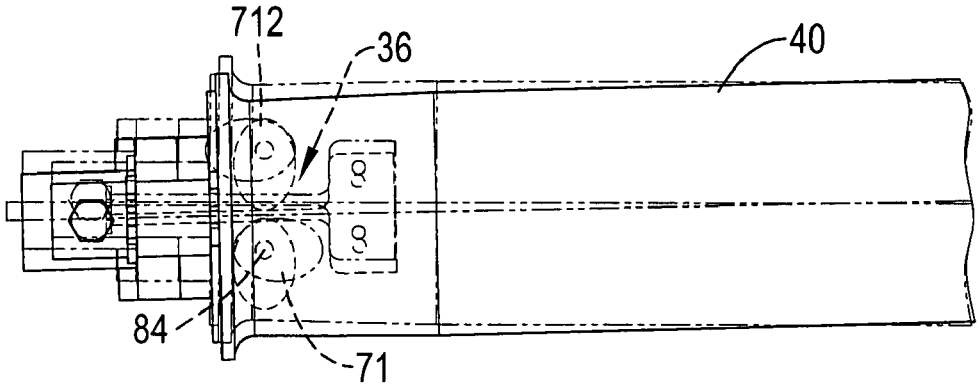
FIG. 7 is an operational top view of the automatic adjustment device in FIG. 6 showing the driven axle bracket being pushed by one of the cams (71,712) to pivot.
Figure 8:
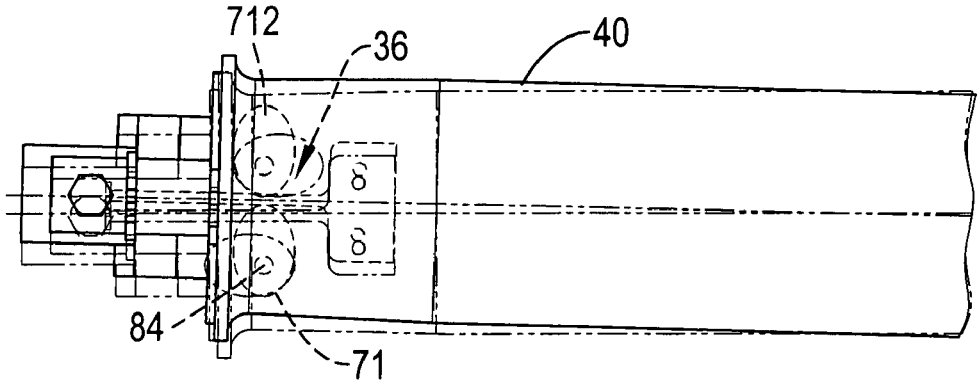
FIG. 8 is an operational top view of the automatic adjustment device in FIG. 6 showing the driven axle bracket being pushed by the other cam to pivot.

After positions of the driven axle bracket (30) and the cams (71,712) being zeroized, the driving belt (74) is mounted around the driving and driven pulleys (72,73). Consequently, the driving pulley (72) will be rotated simultaneously with the driving axle (20), and the cams (71,712) are rotated with the transmission of the driving belt (74), the driven pulley (73), the driving shaft (83), the gear device and the driven shafts (84). With reference to FIGS. 6 to 8, the pushed element (36) will be alternatively pushed by the cams (71,712) to make the driven axle bracket (30) to swing relative to the central shaft (32) in a simple harmonic motion. With the swinging of the driven axle bracket (30), the travel track of the running belt (60) can be automatically and actively adjusted, such that the movement of the running belt (60) is stable and smooth. In addition, the belt (60) can be kept from being worn off at a single edge, and the useful life of the belt (60) can be prolonged and the belt (60) is durable.

Figure 12:
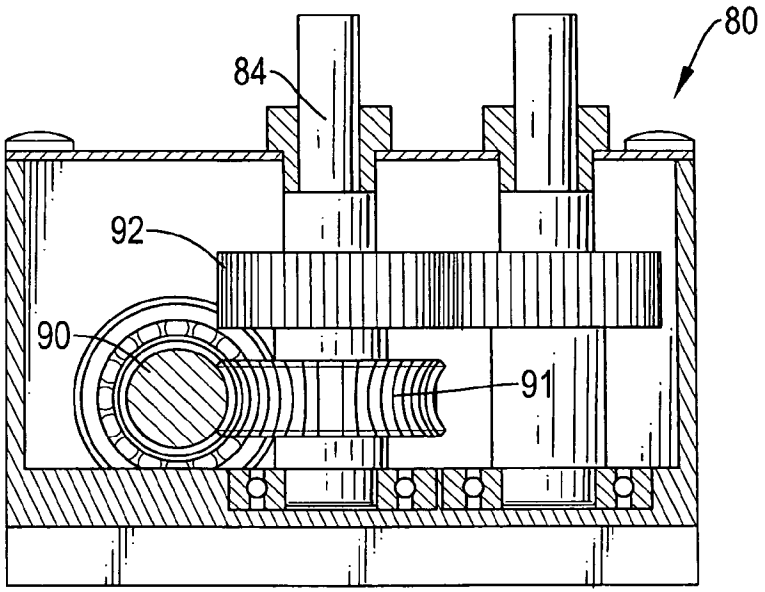
FIG. 12 is a side view in partial section of the transmission device in FIG. 11.
Figure 11:
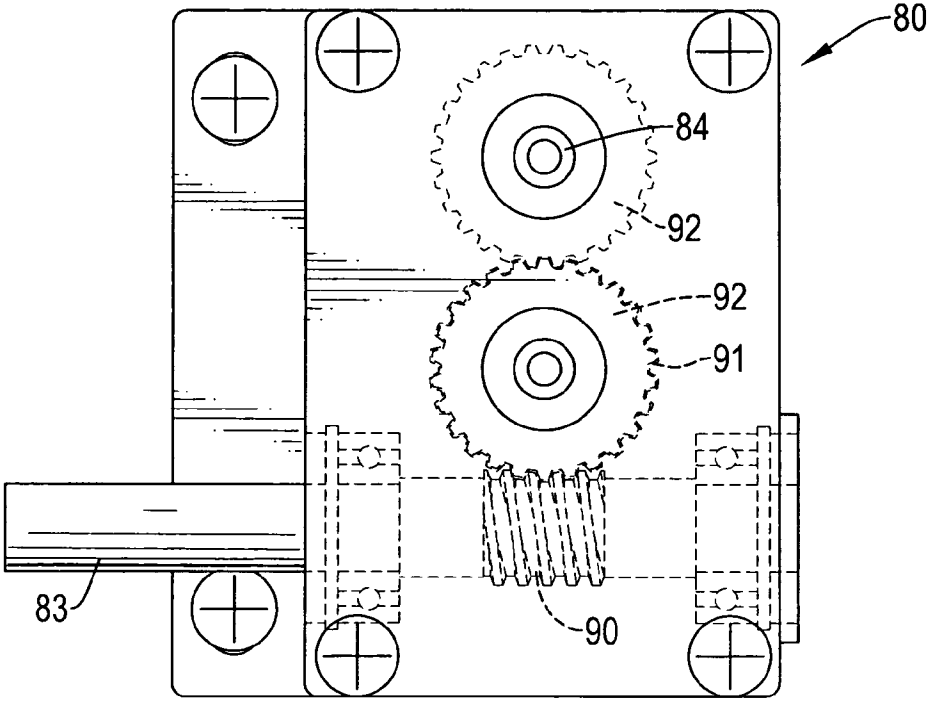
FIG. 11 is a top view in partial section of another embodiment of a transmission device of the automatic adjustment device of the wide belt sander in FIG. 1.

With reference to FIGS. 11 and 12, the gear device of the transmission device (80') may comprise a worm rod (90), a worm gear (91) and two transmitting gears (92). The worm rod (90) is coaxially mounted on the driving shaft (83). The worm gear (91) is mounted on one of the driven shafts (84) and engages with the worm rod (90). The transmitting gears (92) are mounted respectively on the driven shafts (84) and engage with each other. Accordingly, when the driving shaft (83) rotates, the cams (71,712) are rotated in opposite directions with the transmission of the worm rod (90), the worm gear (91), the transmitting gears (92) and the driven shafts (84).

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A wide belt sander comprising:

a base (10);

a driving axle (20) rotatably mounted on the base (10) and having a central axis;

a driving device mounted on the base (10) and connected to the driving axle (20);

a driven axle bracket (30) rotatably mounted on the base (10) along a longitudinal axis perpendicular to the central axis of the driving axle (20);

a driven axle (40) rotatably mounted on the driven axle bracket (30) along a rotating axis parallel with the central axis of the driving axle (20);

a belt (60) endlessly mounted around the driving and driven axles (20,40); and an automatic adjustment device (70) mounted between the base (10) and the driven axle bracket (30) to drive the driven axle bracket (30) to swing relative to the base (10) along the longitudinal axis in a simple harmonic motion and comprising two cams (71,712) rotatably mounted on the base (10) at an interval and corresponding to the driven axle bracket (30);

a pushed element (36) securely attached to the driven axle bracket (30) and mounted between and alternatively pushed by the cams (71,712) to swing the driven axle bracket (30) relative to the base (10); and a driving assembly mounted on the base (10) to drive the cams (71,712) to rotate.

2. The wide belt sander as claimed in claim 1, wherein the cams (71,712) are arranged symmetrically to the pushed element (36) and alternatively push the pushed element (36) at a 180° interval.

3. The wide belt sander as claimed in claim 1, wherein the driving assembly of the automatic adjustment device (70) comprises a gear box (82) adjustably attached on the base (10);

a driving shaft (83) rotatably mounted on and extending into the gear box (82);

two driven shafts (84) rotatably mounted on and extending out from the gear box (82), arranged in parallel and to which the cams (71,712) are attached respectively; and a gear device mounted in the gear box (82), connected between the driving shaft (83) and the driven shafts (84) to drive the driven shafts (84) to rotate in reverse directions and comprising a worm rod (86) coaxially mounted on the driving shaft (83); and two worm gears (87) securely and respectively mounted on the driven shafts (84) and engaging with the worm rod (86).

4. The wide belt sander as claimed in claim 1, wherein the driving assembly of the automatic adjustment device (70) comprises a gear box (82) adjustably attached on the base (10);

a driving shaft (83) rotatably mounted on and extending into the gear box (82);

two driven shafts (84) rotatably mounted on and extending out from the gear box (82), arranged in parallel and to which the cams (71,712) are attached respectively; and a gear device mounted in the gear box (82), connected between the driving shaft (83) and the driven shafts (84) to drive the driven shafts (84) to rotate in reverse directions and comprising a worm rod (90) coaxially mounted on the driving shaft (83);

a worm gear (91) mounted on one of the driven shafts (84) and engaging with the worm rod (90); and two transmitting gears (92) mounted respectively on the driven shafts (84) and engaging with each other.

5. The wide belt sander as claimed in claim 3, wherein the base (10) has a channel (142) defined along a direction perpendicular to the central axis of the driving axle (20); and two threaded holes (144); and the gear box (82) has a bottom;

two ribs (822) formed on the bottom and slidably held in the channel (142) in the base (10); and a wing (824) mounted on and laterally extending from the bottom of the gear box (82) and having two elongated holes (826) defined through the wing (824) and aligning respectively with the threaded holes (144) in the base (10).

6. The wide belt sander as claimed in claim 4, wherein the base (10) has a channel (142) defined along a direction perpendicular to the central axis of the driving axle (20); and two threaded holes (144); and the gear box (82) has a bottom;

two ribs (822) formed on the bottom and slidably held in the channel (142) in the base (10); and a wing (824) mounted on and laterally extending from the bottom of the gear box (82) and having two elongated holes (826) defined through the wing (824) and aligning respectively with the threaded holes (144) in the base (10).

7. The wide belt sander as claimed in claim 5, wherein the base (10) further has an indicating board (18) securely attached to the base (10) and having an upper indication channel (182) laterally defined through the indicating board (18); and a lower indication channel (184) laterally defined through the indicating board (18) and parallel with the upper indication channel (182);

the pushed element (36) has an upper pointer (362) formed on one end of the pushed element (36) and extending into the upper indication channel (182) in the indicating board (18); and the gear box (82) further comprises a lower pointer (828) securely mounted on the gear box (82) and extending into the lower indication channel (184) in the indicating board (18).

8. The wide belt sander as claimed in claim 6, wherein the base (10) further has an indicating board (18) securely attached to the base (10) and having an upper indication channel (182) laterally defined through the indicating board (18); and a lower indication channel (184) laterally defined through the indicating board (18) and parallel with the upper indication channel (182);

the pushed element (36) has an upper pointer (362) formed on one end of the pushed element (36) and extending into the upper indication channel (182) in the indicating board (18); and the gear box (82) further comprises a lower pointer (828) securely mounted on the gear box (82) and extending into the lower indication channel (184) in the indicating board (18).

9. The wide belt sander as claimed in claim 1, wherein the base (10) comprises a bottom frame (11);

a column (12) mounted on the bottom frame (11);

a slider (13) slidably mounted on the column (12);

a holding bracket (14) securely mounted on the slider (13) and to which the driven axle bracket (30) is rotatably connected and the gear box (82) of is adjustably mounted; and an axle frame (16) securely attached to the holding bracket (14); and the driving axle (20) is rotatably mounted between the slider (13) and the axle frame (16) below the holding bracket (14).

10. The wide belt sander as claimed in claim 1 further comprising a pneumatic cylinder (34) mounted between the base (10) with a universal jointer and the driven axle bracket (30).

11. The wide belt sander as claimed in claim 10 further comprising an axle adjusting device (50) mounted between the base (10) and the driven axle bracket (30) to change a distance between the driving and driven axles (20,40) and comprising a handlebar (52) pivotally attached to the base (10) and having a guiding channel (522) defined through the handlebar (52) at one end of the handlebar (52);

a pushing plate (54) pivotally mounted on the base (10) and pivotally and slidably connected to the guiding channel (522) in the handlebar (52); and a pushed rod (322) mounted on driven axle bracket (30) and abutting with the pushing plate (54).

12. The wide belt sander as claimed in claim 1, wherein the driving assembly of the automatic adjustment device comprises a driving pulley (72) coaxially connected to and rotating with the driving axle (20);

a driven pulley (73) connected to the cams (71,712) with a transmission device;

a driving belt (74) mounted around the driving pulley (72) and the driven pulley (73).

* * * * *